US007536944B2

(12) United States Patent
Yoh et al.

(10) Patent No.: US 7,536,944 B2
(45) Date of Patent: May 26, 2009

(54) AIR PRESSURE CYLINDER FOR POSITIONING CONTROL

(75) Inventors: Seikai Yoh, Tsukuba-gun (JP); Masatoshi Hatakeyama, Tsukuba-gun (JP); Kazuo Nakano, Tsukuba-gun (JP); Hiroshi Miyachi, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 201 days.

(21) Appl. No.: 11/347,310

(22) Filed: Feb. 6, 2006

(65) Prior Publication Data

US 2006/0184259 A1 Aug. 17, 2006

(30) Foreign Application Priority Data

Feb. 14, 2005 (JP) ..... 2005-036494

(51) Int. Cl.
*F15B 15/26* (2006.01)

(52) U.S. Cl. ..... 92/26

(58) Field of Classification Search ..... 92/18, 92/26, 27

See application file for complete search history.

(56) References Cited

U.S. PATENT DOCUMENTS

| | | | | |
|---|---|---|---|---|
| 1,989,387 | A * | 1/1935 | Vickers | 92/27 |
| 2,394,785 | A * | 2/1946 | Kindervater | 92/28 |
| 5,467,599 | A | 11/1995 | Fargo et al. | |
| 5,921,554 | A | 7/1999 | Derian et al. | |
| 5,958,262 | A | 9/1999 | Palko et al. | |

FOREIGN PATENT DOCUMENTS

| | | |
|---|---|---|
| DE | 43 43 963 C2 | 6/1994 |
| DE | 196 43 302 A1 | 4/1997 |
| DE | 100 02 919 B4 | 11/2000 |
| JP | 1-152104 | 10/1989 |
| JP | 11-287212 | 10/1999 |
| JP | 2002-61610 | 2/2002 |
| JP | 2004-144196 | 5/2004 |

* cited by examiner

*Primary Examiner*—F. Daniel Lopez
(74) *Attorney, Agent, or Firm*—Oblon, Spivak, McClelland, Maier & Neustadt, P.C.

(57) ABSTRACT

A slight-vibration-suppressing mechanism is attached to a piston rod 6 of an air pressure cylinder that stops the piston at a target position by means of a positioning control. The slight-vibration-suppressing mechanism includes a friction member formed of a pair of sealing members being in contact with the piston rod, and an air cell of compressed air fed to a periphery of the piston rod is formed by means of the friction member. An air flow path to feed and discharge the compressed air to the aforementioned air cell is formed, in which the compressed air generates a sliding friction, which suppresses slight vibration, via the friction member between the piston rod and the aforementioned friction member.

4 Claims, 8 Drawing Sheets

A

B

A

B

AIR PRESSURE CYLINDER FOR POSITIONING CONTROL

TECHNICAL FIELD

The present invention relates to an air pressure cylinder for positioning control configured to stop a piston at a target position by means of a positioning control, and in particular, to an air pressure cylinder for positioning control configured to suppress a slight vibration of the piston that occurs in the vicinity of the target position of the positioning, or the like, by means of a simple device.

BACKGROUND ART

When performing a positioning control at an arbitrary half-way stopping position using an air pressure cylinder, a slight vibration of a piston tends to occur in the vicinity of a target position of the positioning or in the middle of movement for the positioning. This is an impediment of a high capability positioning control.

The cause of this slight vibration of the piston is considered as follows. In comparison with a control system of an electric positioning control system or an oil pressure positioning control system, the positioning control system using the air pressure cylinder (for example, the control system that is not provided with a slight-vibration-suppressing mechanism 20, in FIG. 1) has a characteristics of low rigidity and insufficient attenuation, and in addition, in a piston packing (Refer to numeral 5*a* in FIG. 1), turn and/or twist tend to occur in the vicinity of a neutral point. Accordingly, a large fluctuation of frictional resistance tends to occur, and the larger the coulomb friction and viscosity that occur at the packing portion are, the larger the effect of suppressing the slight vibration of the piston is, by nature. However, friction force of the piston packing of a large diameter is far larger than that of a rod packing of a small diameter in a usual cylinder, and this dominantly decides the friction characteristic of an entire drive system. Consequently, when the turn and the twist occur in the piston packing, the frictional resistance against the rod notably lowers, the effect of preventing the slight vibration lowers, and depending on a case, this serves as an encouragement for the vibration.

In relation to those problems, an air pressure cylinder whose piston rod has a variable damper using electric viscosity fluid attached thereto (refer to patent document 1), or a device that performs precise positioning by means of employing a static pressure bearing in a sliding portion (refer to patent document 2) are hitherto known. The former, i.e., the air pressure cylinder is provided with a damper piston having the electric viscosity fluid in the reciprocating piston rod and varies fluidity of the electric viscosity fluid by means of control of an electric field at the damper piston, and thereby the air pressure cylinder controls moving resistance of the rod. On the other hand, the latter, i.e., the positioning device uses a non-contact type piston, which is operated by means of a static pressure bearing and thereby improves positioning control accuracy and load control accuracy of a precise control device in a cylinder that feeds fluid being controlled via a servo valve into a pressure chamber.

However, in the conventional device that performs the positioning control by means of those systems, an equipment for controlling the frictional characteristics of the piston or the piston rod has to be large sized and complicated, and as a result, any one of those devices has to be manufactured at high costs. In addition, when the static pressure bearing is employed, there is little sliding friction and the damping effect due to the friction cannot be expected. Accordingly, the aforementioned slight vibration tends to easily occur. (Refer to FIG. 12 in the patent document 2)

Japanese Unexamined Patent Application Publication No. 11-287212

Japanese Unexamined Patent Application Publication No. 2004-144196

DISCLOSURE OF THE INVENTION

A technical problem to be solved by the invention is to effectively suppress a slight vibration of a piston that occurs in the vicinity of a target position of positioning for the piston or in the middle of movement of the positioning for the piston by means of employing an extremely simple device, and to make it possible to realize the positioning of high speed and high accuracy in an air pressure cylinder for positioning control.

To solve the above-described problems, the present invention is characterized in providing an air pressure cylinder for positioning control, in which a slight-vibration-suppressing mechanism is attached to a piston rod of the air pressure cylinder for stopping a piston at a target position by means of positioning control, and in which the slight-vibration-suppressing mechanism includes a friction member being in contact with the piston rod, and an air cell for containing compressed air to be fed to a periphery of the piston rod is formed by means of the friction member, and in which an air flow path for feeding and discharging the compressed air is formed, in which the compressed air generates a sliding friction for suppressing the slight vibration via the friction member between the friction member and the piston rod.

In a preferred embodiment of the aforementioned air pressure cylinder for positioning control, the friction member, the air cell, and the air flow path constituting the slight-vibration-suppressing mechanism are provided in a rod cover or a connecting member to be connected thereto and, the friction member being in contact with the surface of the piston rod is formed of a pair of sealing members having a function to form a seal between the surface of the piston rod and the sealing member at both ends of the air cell in an axial direction of the piston rod. Further, the pair of sealing members is formed of V-packings for preventing a discharge of the compressed air from the air cell, and an air flow path for feeding and discharging the compressed air is provided between both of the V-packings.

In another preferred embodiment of the present invention, a pressure-adjusting device for adjusting pressure of the compressed air to be fed to the air cell is provided into the air flow path.

In the air pressure cylinder for positioning control having the aforementioned construction, the friction member being in contact with the piston rod is pressed to the piston rod and a sliding friction for suppressing the aforementioned slight vibration is generated therebetween. Accordingly, the aforementioned slight vibration can be effectively suppressed.

Thus, according to an air pressure cylinder for positioning control of the present invention, a slight vibration of the piston that occurs in the vicinity of the target position of the positioning or in the middle of the movement of the piston for the positioning can be effectively suppressed by means of extremely simple device, and the positioning of the piston at high speed and high accuracy can be realized.

In addition, it is confirmed by an experiment that the aforementioned construction of the air pressure cylinder for the positioning is effective to suppress the vibration of the piston rod in a radial direction by means of providing a friction member.

BRIEF DESCRIPTION OF THE DRAWINGS

FIG. 4A illustrates displacement as a whole, and FIG. B illustrates an enlarged view of the vicinity the target position.

FIG. 7A shows the displacement of the piston rod in the present invention and FIG. 7B shows that of the conventional example.

BEST MODE FOR CARRYING OUT THE INVENTION

Figure 1:
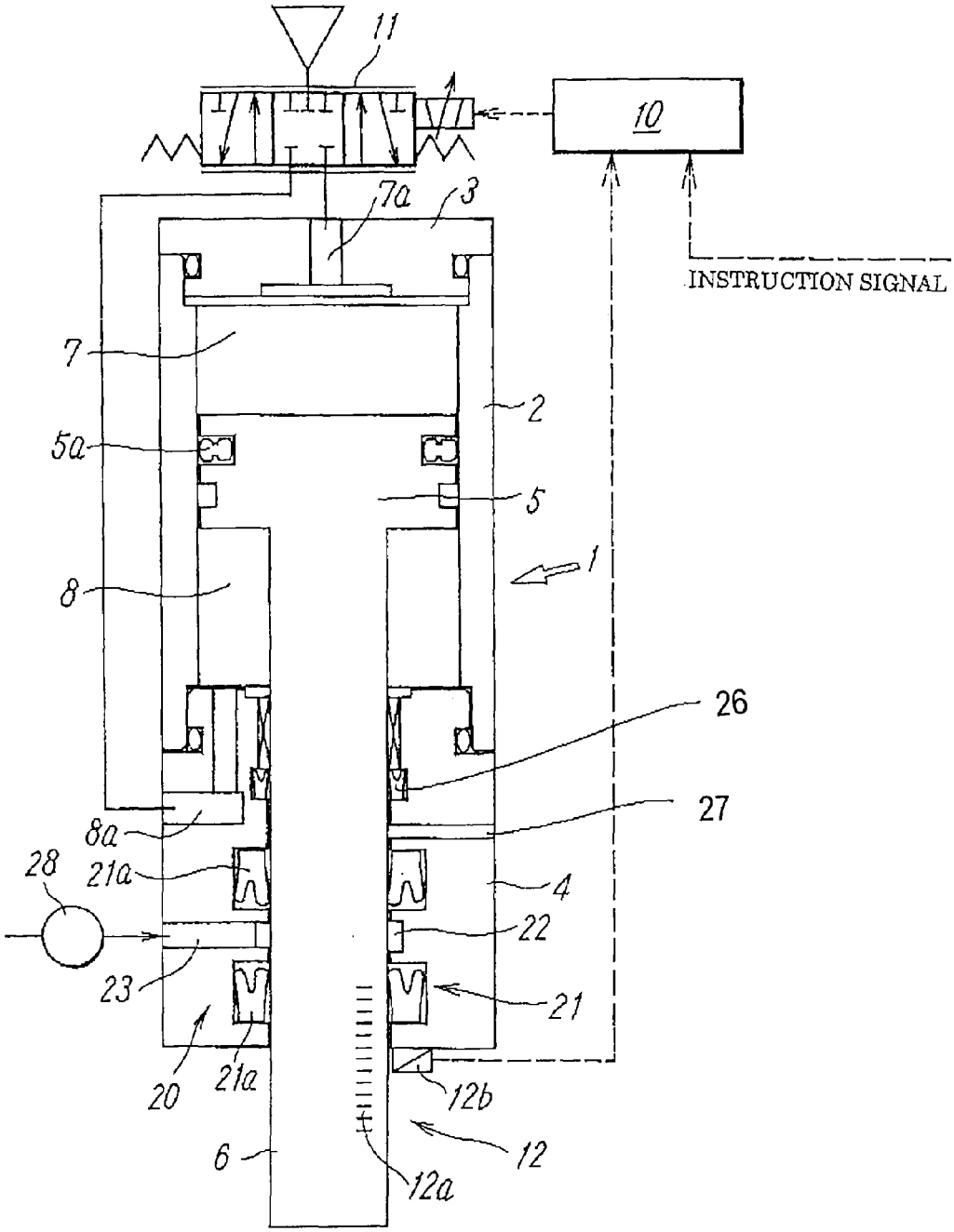
FIG. 1 is a main part longitudinal construction view schematically illustrating a construction of an embodiment of an air pressure cylinder for positioning control in accordance with the present invention.
Figure 2:
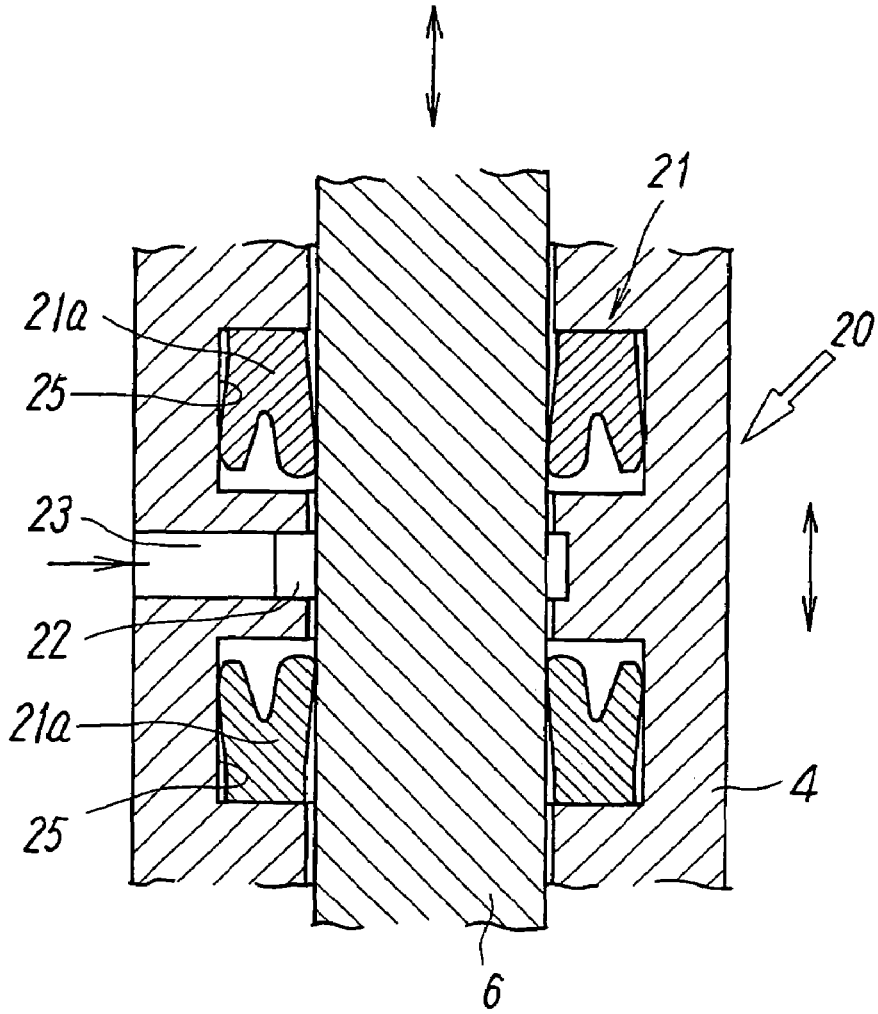
FIG. 2 is a cross-section illustrating a slight-vibration-suppressing mechanism of the embodiment of FIG. 1.

FIGS. 1 and 2 illustrate an embodiment of an air pressure cylinder for positioning control with respect to the present invention. In the air pressure cylinder for positioning control, basically, both ends of a cylinder tube 2 in an air pressure cylinder 1 is closed by means of a head cover 3 and a rod cover 4. Further, a piston rod 6 of a piston 5, which is slidably fit into the cylinder tube 2, is penetrated through the rod cover 4 and led out, as shown in FIG. 1. A piston packing 5*a*, which is formed of a rubber elastic material, is attached to the piston 5, and as shown in the drawing, the packing having a potbellied shape in cross-section is frequently used. In addition, required compressed air is fed into pressure chambers, 7 and 8, of a head side and a rod side, respectively, which are partitioned by means of the piston 5, from a servo valve 11 having five ports being controlled by means of a controller 10, through each of feeding and discharging ports, 7*a* and 8*a*, and thus, the positioning control for the piston is performed.

In the positioning control, a positioning sensor 12 is provided so as to detect a moving position of a cylinder by means of a device for detecting a magnetic scale 12*a* formed on the piston rod 6 by a magnetic sensor 12*b*, or the like device. Further, the compressed air to be fed into and discharged from the pressure chambers, 7 and 8, of the cylinder from the servo valve 11 is controlled by means of the aforementioned controller 10 on the basis of a cylinder position signal from the positioning sensor 12 and an instruction signal relevant to a stopping target position of the piston provided from outward, and the piston 5 is stopped at a predetermined target position.

The aforementioned positioning control system of the air pressure cylinder is an example of the positioning control system, which is hitherto extra ordinarily commonly used. The present invention is not limited to the aforementioned control system and is applicable of various kinds of positioning systems. However, in any one of the positioning systems, a turn and a twisting of the piston packing 5*a* tend to occur in the vicinity of the neutral point, as described earlier. A large fluctuation of the frictional resistance tends to occur, accordingly.

Therefore, a slight-vibration-suppressing mechanism 20 having a simple construction is attached to the rod cover 4 of the aforementioned cylinder 1 in the air pressure cylinder for positioning control in accordance with the present invention.

In the slight-vibration-suppressing mechanism 20, a friction member 21 that generates a sliding friction by being in contact with the piston rod 6 in the rod cover 4, as shown in FIGS. 1 and 2 is provided. In addition, an air cell 22 containing the compressed air is formed at a periphery of the piston rod 6 by means of the friction member 21, and an air flow path 23 for feeding the compressed air to and discharging the compressed air from the air cell 22 is provided in the rod cover 4. The compressed air fed to the air cell 22 is configured to generate sliding friction for suppressing the slight vibration via the friction member 21 between the friction member 21 and the piston rod 6.

Further, the friction member 21, the air cell 22, and the air flow path 23 that constitute the slight-vibration-suppressing mechanism 20 do not always have to be provided on the rod cover 4, and the same component can be provided in a separate connecting member, or the like, which is connected to the rod cover 4.

In more concrete explanation, the friction member 21 being in contact with a surface of the piston rod 6 is formed by means of sealing members, 21*a* and 21*a*, formed of a pair of V-packing or the like having a function to form a seal between the air cell and the surface of the piston rod 6 at both ends of the air cell 22 in an axial direction of the piston rod 6. Those sealing members, 21*a* and 21*a*, are housed in a manner so as to face a tongue piece of both of the V-packings inside to face each other, such that the discharge of the compressed air from the air cell 22 is prevented. Further, U-shaped grooves, 25 and 25, constitute a part of the air cell 22 formed at both sides of an opening portion of the air flow path 23 of the air cell 22. Thus, a movement of the sealing member 21*a* is limited by means of the U-shaped grooves 25.

The sliding friction between the sealing members, 21*a* and 21*a*, which constitute the friction member 21, and the piston rod 6, is determined by means of pressure of the compressed air led into the air cell 22. It is sufficient when the resultant sliding friction being applied to the piston rod 6 from the sealing members, 21*a* and 21*a* can suppress the slight vibration of the piston rod 6. Preferably, the construction is designed such that force in an axial direction received from the compressed air via the sealing member 21*a* is sufficiently larger than the friction force received from the piston rod 6. In addition, grease or the like lubricant agent is applied to the friction member 21.

Further, in the air flow path 23, as shown in FIG. 1, a pressure adjustment device such as a pressure decrease valve 28 or the like for adjusting the pressure of the compressed air to be fed into the air cell 22 can be provided. The sliding friction, which is applied via the friction member 21, can be adjusted by means of providing the pressure adjustment device, corresponding to the characteristics of the air pressure cylinder per se, or a using condition of the air pressure cylinder. However, it is not necessary to precisely set the air pressure fed into the air cell 22 via the air flow path 23 and is sufficient to be set in an extent by which the slight vibration can be suppressed. In addition, because the sliding friction also varies by means of changing a shape of the friction member 21, a dimension of a surface at which the friction member 21 and the piston rod 6 is in contact with each other, or the like, the air pressure to be fed into the air cell 22 is required to be determined in consideration of various factors.

Additionally, a third sealing member 26 is provided between the pressure chamber 8 and the sealing member 21*a*. The third sealing member 26 prevents compressed air from leaving the pressure chamber 8. Additionally, a hole 27 is provided in the rod cover 4 and extends from an exterior of the rod cover 4 to the piston rod 6.

By such a construction, stable damping force against the relative movement of the piston rod 6 is generated by the friction member 21, and therefore, an effect for suppressing the slight vibration of the piston rod 6 is obtained.

Figure 3:
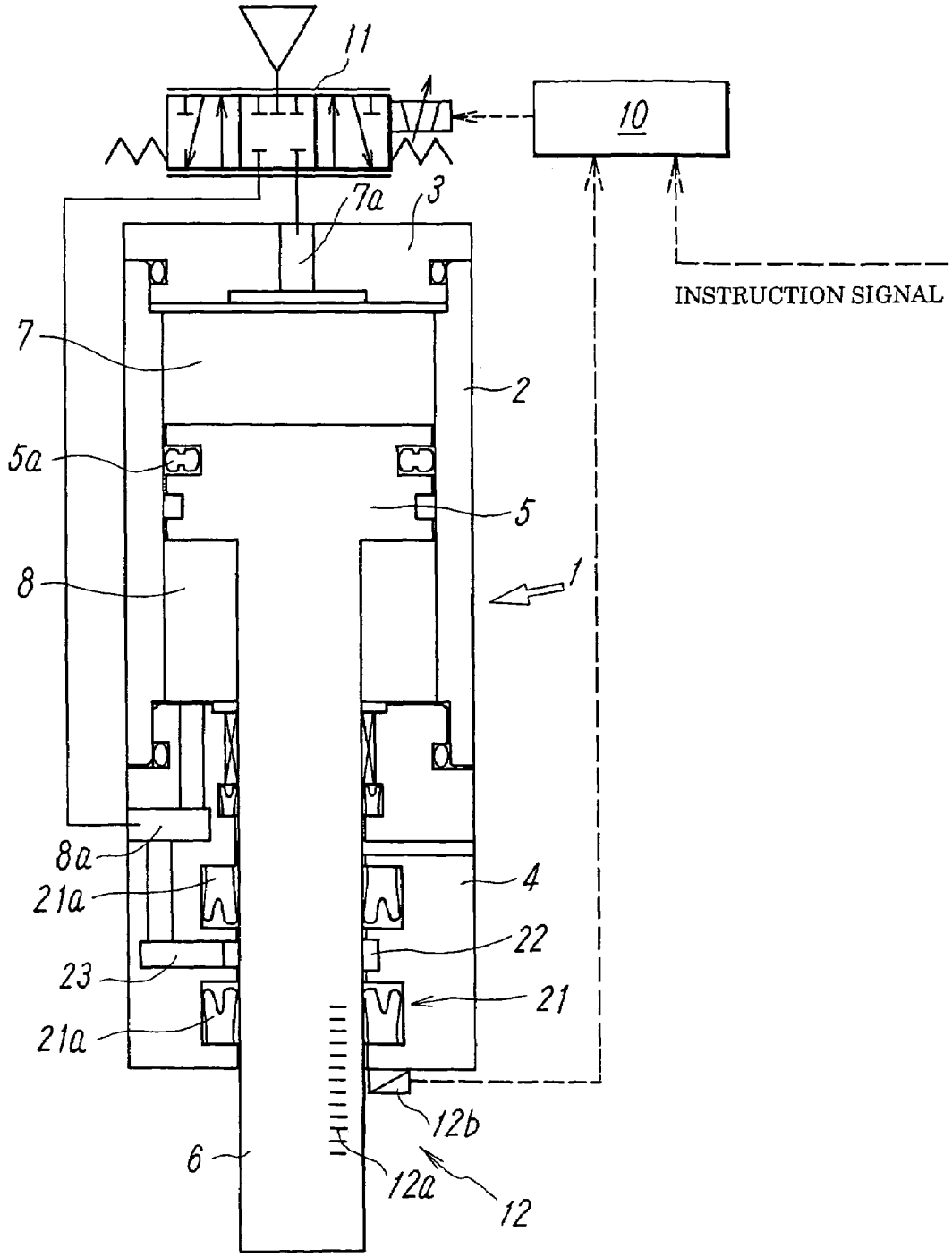
FIG. 3 is a main part longitudinal construction view schematically illustrating a construction of another embodiment of the air pressure cylinder for positioning control in accordance with the present invention.
Figure 4:
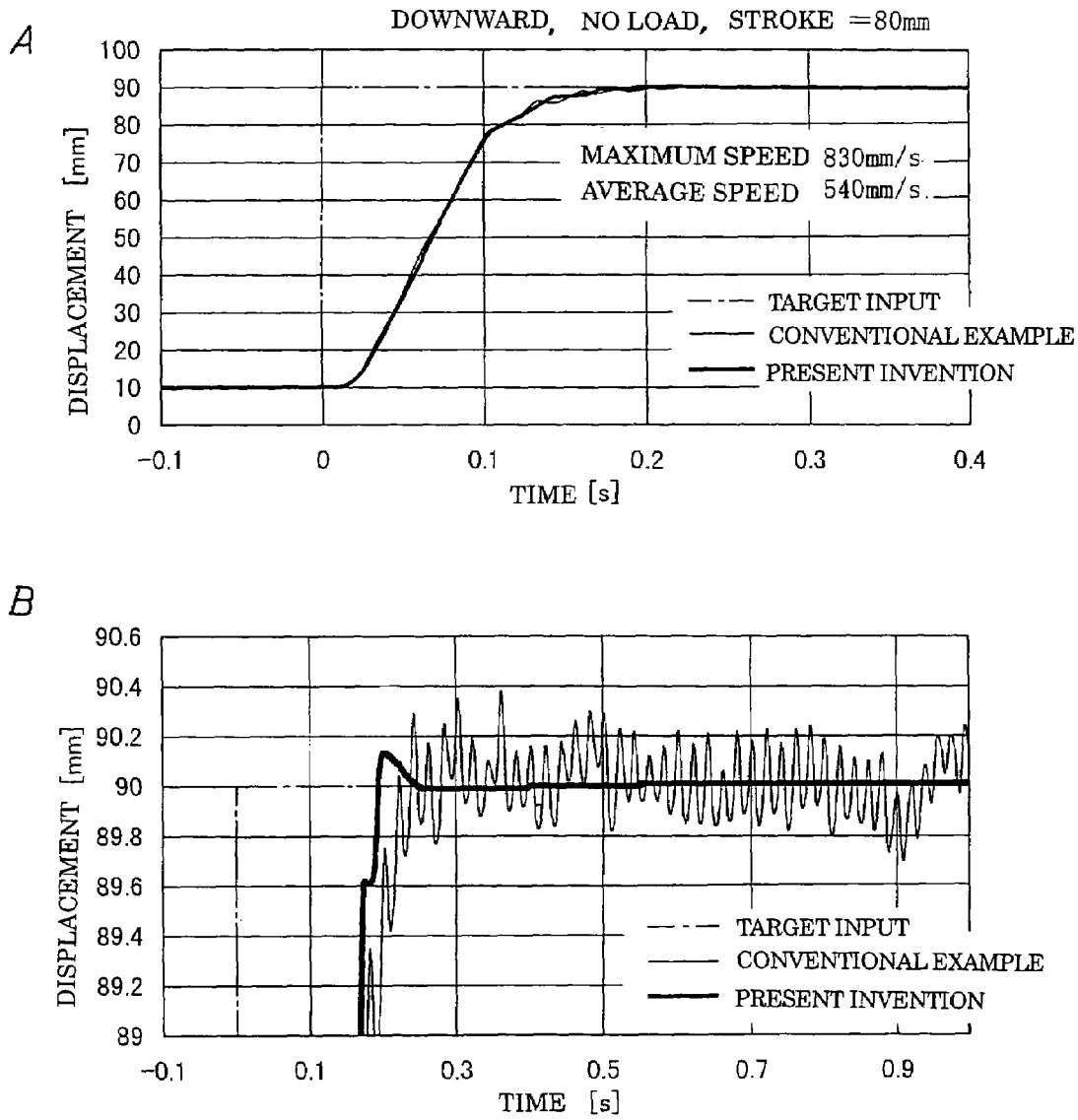
FIGS. 4A and 4B are graphs illustrating a displacement of a piston rod in an exemplary experiment driving the air pressure cylinder in accordance with the present invention and the conventional example.
Figure 5:
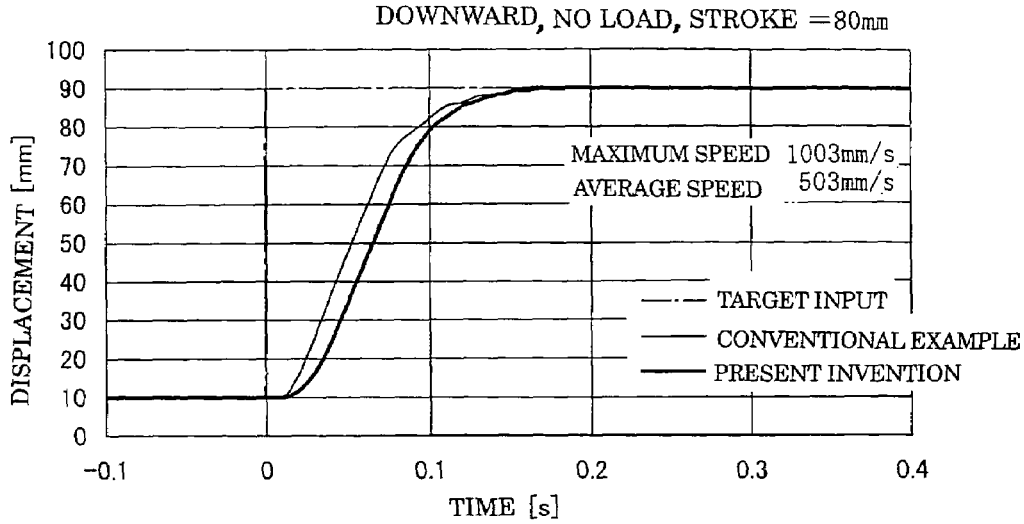
FIGS. 5A and 5B are graphs similar to that of the case of the similar experiment under a different condition from FIG. 4A and FIG. 4B.
Figure 5:
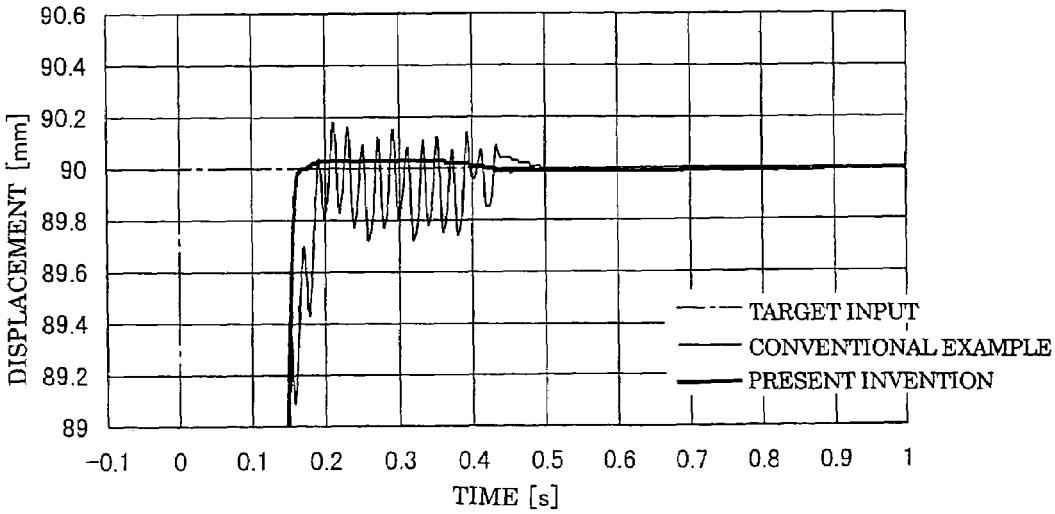

FIG. 3 illustrates another embodiment of the air pressure cylinder for positioning control in accordance with the present invention and in this embodiment, the flowing path for feeding and discharging the compressed air from the servo valve 11 to the pressure chamber 8 of the rod side is branched in the discharging port 8*a* and the branched tube serves as the air flow path 23 toward the air cell 22.

At this moment, the construction and the function of the air pressure cylinder for positioning control other than that described above, shown in FIG. 3 are substantially the same as those explained in FIG. 1, and therefore, the same parts or corresponding parts in the main construction are denoted by the same numerals and the explanation thereof is omitted.

Next, various examples of experiment relevant to the air pressure cylinder for positioning control in accordance with the present invention is explained referring to FIGS. 4A and 4B through 8.

Figure 6:
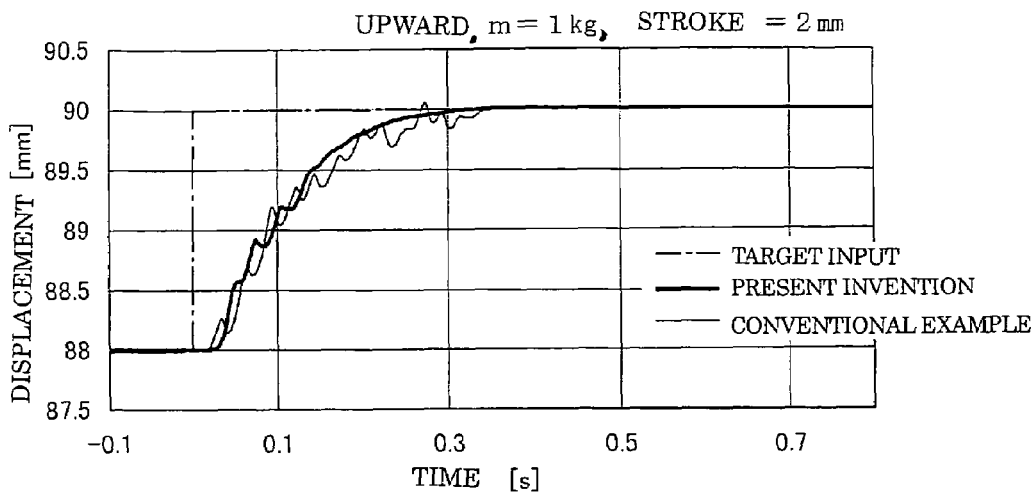
FIGS. 6A and 6B are graphs similar to that of the case of the similar experiment under a different condition from FIG. 4A and FIG. 4B.
Figure 6:
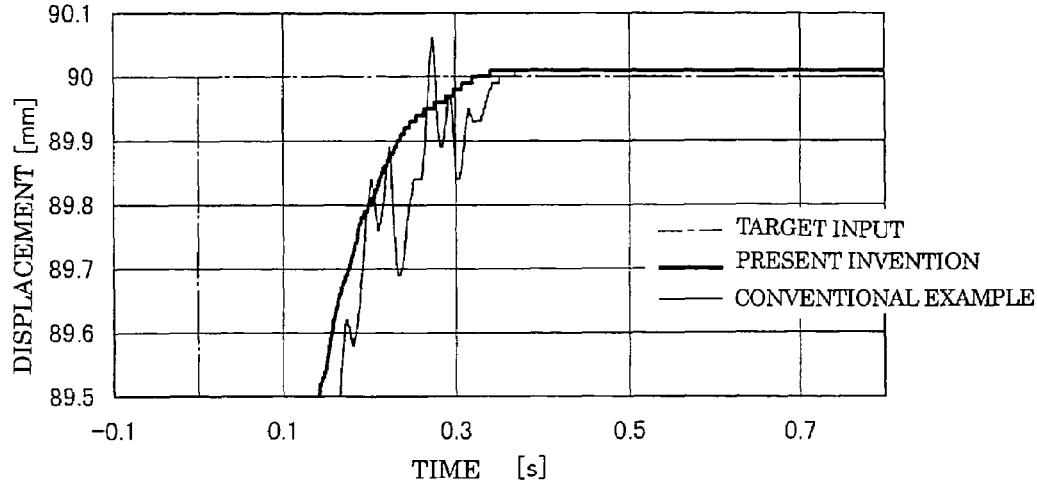
Figure 7:
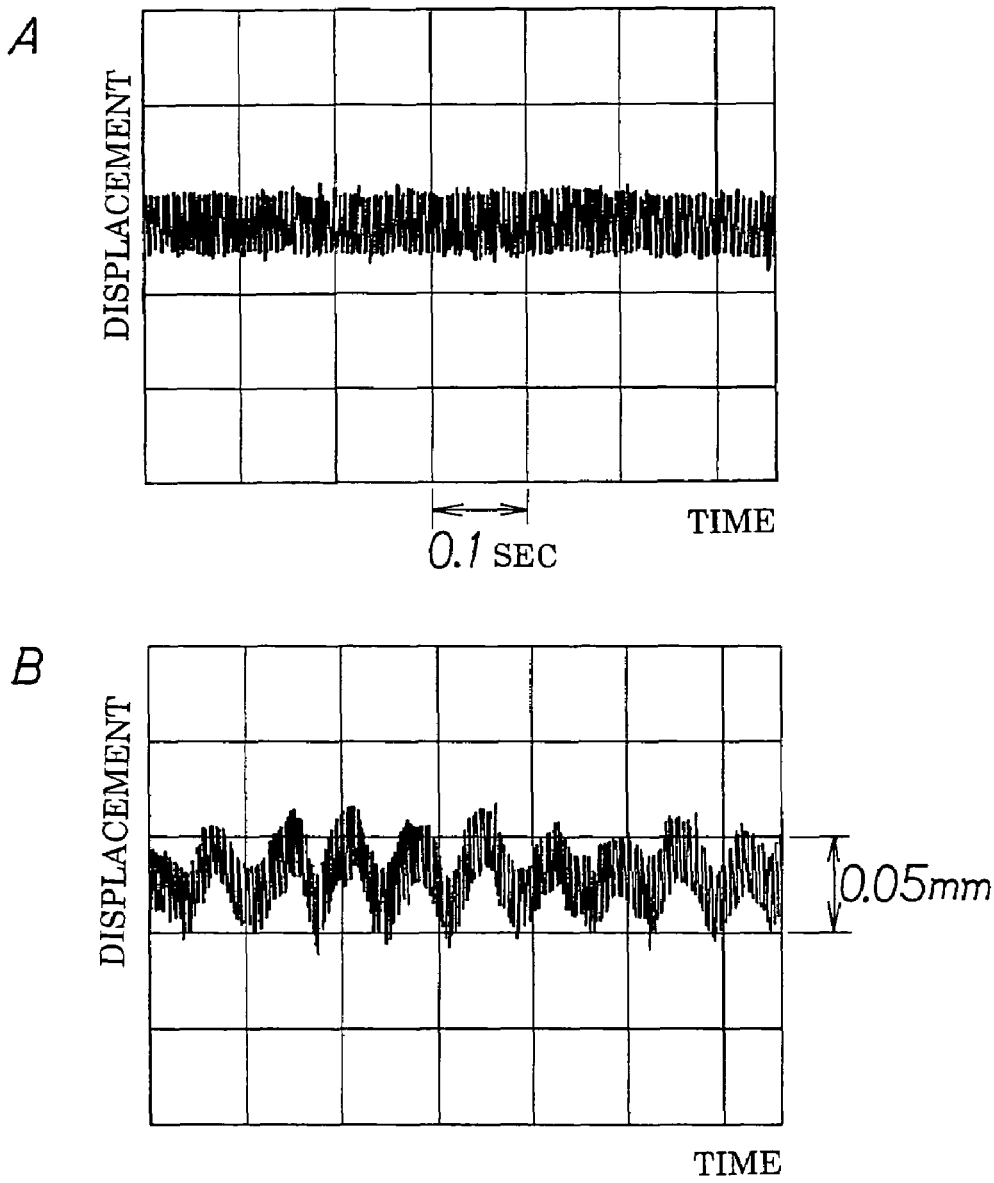
FIGS. 7A and 7B are illustrations showing a displacement in a radial direction of the piston rod in a case of driving the air pressure cylinder in accordance with both the present invention and the conventional example.

First, in the experiments, shown in FIGS. 4A and 4B through 6A and 6B, the air pressure cylinder 1, which is substantially the same as that, shown in FIGS. 2 and 3, is used for the experiment of the present invention, and the air pressure cylinder, shown in FIG. 1, from which the slight-vibration-suppressing mechanism 20 is removed, is used for the experiment of the conventional example. Further, the results of the experiment under the condition shown in those figures are indicated. Furthermore, the condition other than the above-described is completely the same in each of the case of the present invention and that of the conventional example. In addition, each of FIGS. 4A, 4B, 5A and 5B illustrate displacement of the piston rod in the vicinity of the target position in a case when the air pressure cylinder is driven, while FIGS. 6A and 6B illustrate the displacement of the piston rod in the middle of the movement, and the A-figures show the entire illustration of displacement of the piston rod, while the B-figures show the enlarged illustration of the displacement of the piston rod in the vicinity of the target position.

As is clear from each of the B-figures and FIG. 6A, in a case of the air pressure cylinder in accordance with the present invention provided with the aforementioned slight-vibration-suppressing mechanism 20, the damping effect for the slight vibration by means of the aforementioned slight-vibration-suppressing mechanism 20 is prominent in comparison with the conventional example. Accordingly, the construction in accordance with the present invention contributes to the realization of the stable positioning by means of suppressing the slight vibration without almost exerting influence on entire answering time.

Further, FIGS. 7A and 7B illustrate each of the results obtained by measuring the displacement in the radial direction of each of the piston rod 6 of the present invention and that of the conventional example, using the air pressure cylinder similar to that used in the above-described construction, which is measured by means of laser displacement meter. A noise of a measurement system is found in both of FIGS. 7A and 7B. However, while the displacement of the piston rod 6 in the radial direction is hardly recognized in the case in accordance with the present invention, shown in FIG. 7A, the displacement in the radial direction is recognized as undulation waveform in an extent of 0.03 mm in the case of the conventional example, shown in FIG. 7B.

According to the result of this experiment, it can be recognized that, when the slight-vibration-suppressing mechanism 20 exists, not only the effect of suppressing the slight vibration of the piston rod, shown in FIGS. 4A and 4B, through 6A and 6B is obtained, but also the effect of suppressing the vibration in the radial direction is obtained.

Figure 8:
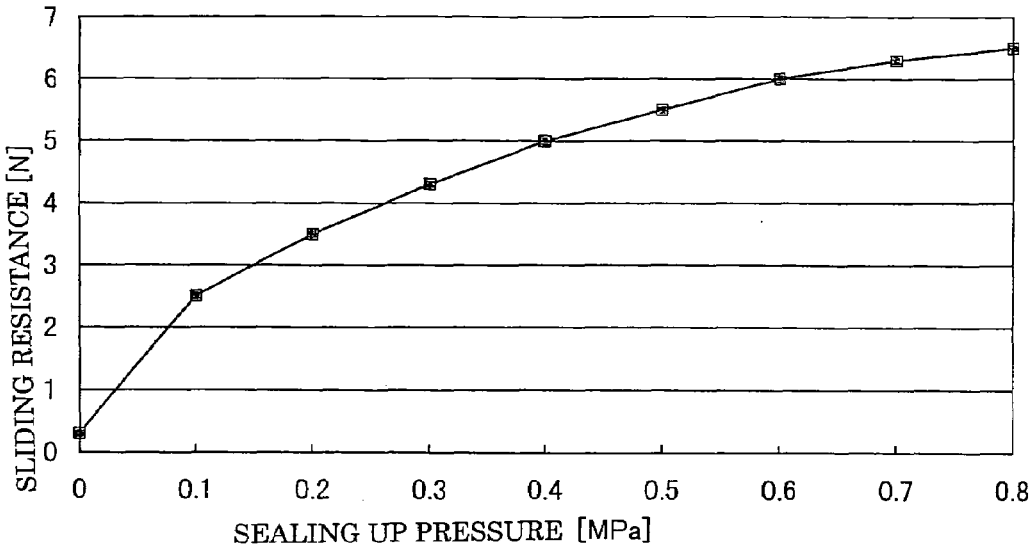
FIG. 8 is a graph showing a tendency of the variation of pressure applied to the air cell in the slight variation suppressing mechanism, and a sliding resistance.

In addition, FIG. 8 illustrates a tendency of a variation of the air pressure applied to the air cell 22 and the sliding resistance of the friction member 21 (sliding speed: 50 mm/sec.). As is clear from FIG. 8, since a slight fluctuation of sealing up pressure caused by means of the air fed into the air cell 22 through the air flow path 23 does not give extraordinary big fluctuation to the sliding friction of the piston rod 6, there is no need to precisely set the pressure to be applied to the air cell 22, as described earlier. In addition, FIG. 8 shows the data relevant to the friction member 21, which is used for the experiment. Further, since the sliding friction substantially changes by means of changing the shape of the friction member, the dimension of the surface at which the friction member 21 and the piston rod 6 is in contact with each other, or the like, the pressure of the air fed into the air cell 22 has to be determined on the basis of actuality.

The invention claimed is:

1. An air pressure cylinder for positioning control, comprising:

a slight-vibration-suppressing mechanism attached to a piston rod of the air pressure cylinder, the air pressure cylinder being configured to stop a piston at a target position by positioning control, wherein the piston is moved by feeding and discharging compressed air to and from a head side pressure chamber and a rod side pressure chamber, and the piston rod penetrates through a rod cover and extends to an exterior of the air pressure cylinder, the slight-vibration-suppressing mechanism comprising:

a pair of one-directional sealing members pressed to the piston rod by compressed air and generating a sliding friction for suppressing slight vibrations, an air cell surrounding a periphery of the piston rod between the pair of sealing members and configured to introduce the compressed air acting on the sealing members, and an air flow path for feeding and discharging the compressed air to the air cell, wherein the pair of sealing members includes a first sealing member and a second sealing member and the pair of sealing members is positioned in a direction such that the compressed air in the air cell presses the sealing members against the piston rod, wherein a third sealing member is provided between the rod side pressure chamber and the first sealing member, and the third sealing member seals off the rod side pressure chamber to prevent compressed air from flowing to the first sealing member, and wherein a hole is formed between the third sealing member and the first sealing member, and the hole makes a gap between the piston rod and the rod cover to communicate with an exterior of the rod cover.

2. The air pressure cylinder for positioning control according to claim 1, wherein the pair of sealing members, the air cell, and the air flow path constituting the slight-vibration-suppressing mechanism are provided in the rod cover or a connecting member to be connected thereto.

3. The air pressure cylinder for positioning control according to claim 2, wherein a pressure-adjusting device for adjusting pressure of the compressed air to be fed to the air cell is provided into the air flow path.

4. The air pressure cylinder for positioning control according to claim 1, wherein a pressure-adjusting device for adjusting pressure of the compressed air to be fed to the air cell is provided into the air flow path.

* * * * *